US007150558B2

(12) United States Patent
Shvartsman et al.

(10) Patent No.: US 7,150,558 B2
(45) Date of Patent: Dec. 19, 2006

(54) DEVICE FOR PRODUCING EMULSIONS, SUSPENSIONS AND THE LIKE

(75) Inventors: Leonid Shvartsman, Kharkiv (UA); Anatoly Potik, Roslyn, NY (US); Ashok Chakram, Kharkiv (UA); Borys Zamotaylov, Kharkiv (UA)

(73) Assignee: AAA Commerce Worldwide, Inc., Roslyn, NY (US)

( * ) Notice: Subject to any disclaimer, the term of this patent is extended or adjusted under 35 U.S.C. 154(b) by 99 days.

(21) Appl. No.: 10/859,728

(22) Filed: Jun. 4, 2004

(65) Prior Publication Data

US 2005/0270900 A1 Dec. 8, 2005

(51) Int. Cl.
*B01F 11/00* (2006.01)

(52) U.S. Cl. ..... 366/119; 366/165.2; 366/336; 138/42

(58) Field of Classification Search ..... 366/119, 366/165.2, 336–338; 138/37, 39, 40, 42, 138/44

See application file for complete search history.

(56) References Cited

U.S. PATENT DOCUMENTS

| | | | | |
|---|---|---|---|---|
| 2,005,800 | A * | 6/1935 | O'Boyle | 366/173.1 |
| 3,081,979 | A * | 3/1963 | Lindsey | 366/119 |
| 3,190,618 | A * | 6/1965 | Katzen | 366/337 |
| 3,278,165 | A * | 10/1966 | Gaffney | 366/119 |
| 4,109,318 | A * | 8/1978 | Hutchings | 366/140 |

* cited by examiner

*Primary Examiner*—David Sorkin
(74) *Attorney, Agent, or Firm*—I. Zborovsky

(57) ABSTRACT

A device for producing emulsions, suspensions and the like of at least two media has a substantially tubular reservoir provided with a first inlet at one axial end so that a first medium is supplied substantially in an axial direction, a second inlet for a second medium provided in a substantially tubular wall of the reservoir so that the second medium is supplied into the reservoir substantially transversely to the axis and therefore to the first medium to produce a mixture, and an outlet for discharging the mixture of the first and second media, means for imparting vibrations and located downstream of the first inlet.

3 Claims, 3 Drawing Sheets

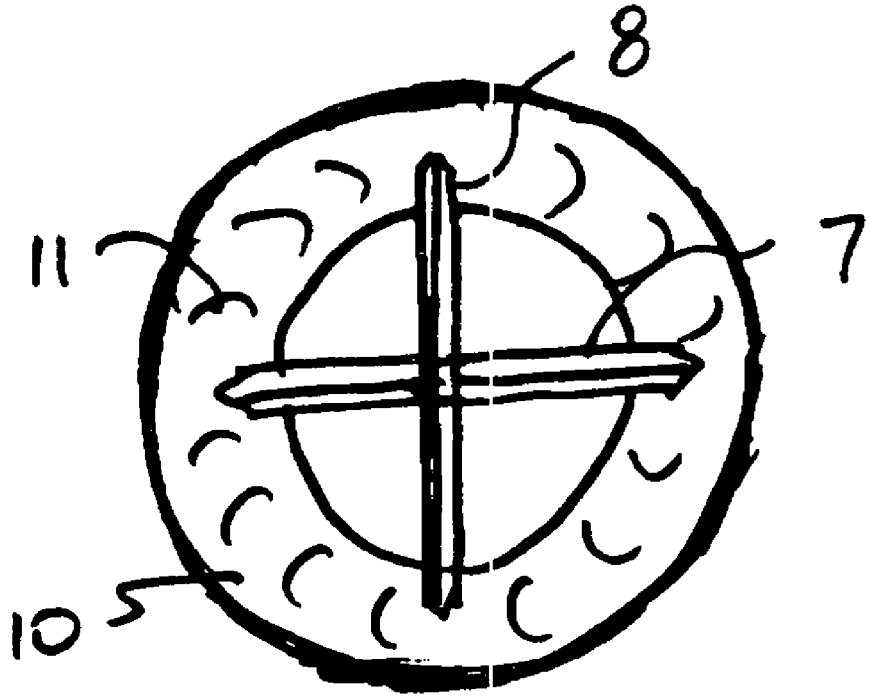
Fig. 2
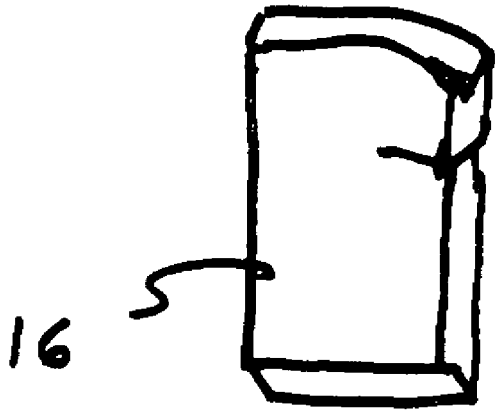
Fig. 3
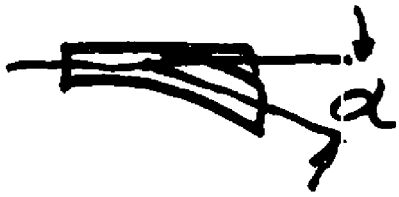

DEVICE FOR PRODUCING EMULSIONS, SUSPENSIONS AND THE LIKE

BACKGROUND OF THE INVENTION

The present invention relates to devices for producing emulsions, suspensions and the like which can be used in a power generating industry, chemical industry, pharmaceutical industry, food processing industry, etc.

Devices for making dispersions and emulsions of liquids under the action of ultrasound vibrations are known. One of such devices is disclosed for example in Ivanov D. M. Fuel emulsions, M, Energy 1968, pages 67–68. The device includes a reservoir in which emulsification takes place and which is filled with a dispersion medium, for example oil, wherein inlets are provided for oil and also for water which forms a second dispersion medium and is continuously supplied to the reservoir. The device has a hydraulic vibrator formed as an ultrasound vessel. The ratio between oil and water corresponds to a desired content of the dispersion phase. The composition is converted into emulsion under the action of ultrasound vibrations produced by the ultrasound vessel. This device has however the disadvantage in a short service life of a resonating plate of the ultrasound vessel, since it is subjected to the action of high dynamic loads commensurate with a fatigue strength of the material. The device also does not provide a necessary degree of dispersion of fuel-water mixtures and their homogenuity, since the liquid located near the walls of the reservoir does not participate in the formation of emulsions.

Another hydraulic mixer is known, which has a housing with a nozzle formed as a diffuser with a smoothly expanding profile facing a screen, and with a whirling device installed in inlet pipes. It is believed that the existing devices can be further improved.

SUMMARY OF THE INVENTION

Accordingly, it is an object of the present invention to provide a device for producing of emulsions, suspensions and the like which is a further improvement of the existing devices.

In keeping with these objects and with others which will become apparent hereinafter, one feature of the present invention resides, briefly stated, in a device for producing of emulsions, suspensions and the like of at least two media, comprising a substantially tubular reservoir provided with a first inlet at one axial end so that the first medium is supplied substantially in an axial direction, and a second inlet for a second medium provided in a substantial tubular wall of the tubular reservoir so that the second medium can be supplied into the reservoir substantially transversely to the axis and therefore to the first medium; means for imparting vibrations to the first medium and located downstream of the first inlet, so as to impart vibrations to the first medium after it enters an interior of the tubular reservoir through the inlet; and means for imparting vibrations to a mixture of the first and second media and located downstream of the second inlet.

When the device is designed in accordance with the present invention, the flow of media is subjected to turbulent pulsations and transverse vibrations and thereby a highly homogenous and finely dispersed emulsion can be obtained, while simultaneously service life and reliability of the device is improved.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view showing one of the elements of the inventive device for a device for producing emulsions, suspensions and the like as seen in an axial direction;

FIG. 3 is a view showing another element of the device for producing emulsions, suspensions and the like in accordance with the present invention.

DESCRIPTION OF THE PREFERRED EMBODIMENTS

Figure 1:
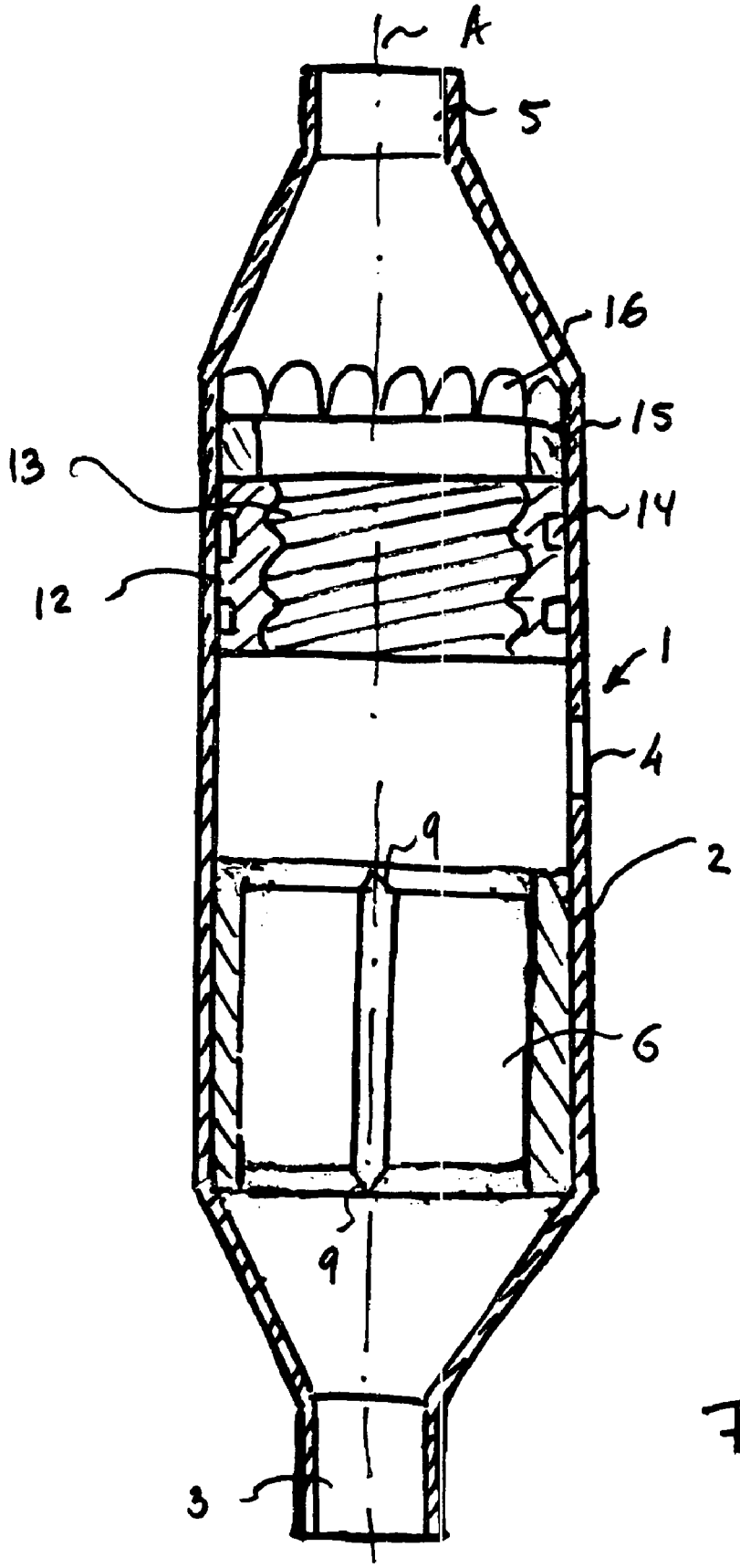
FIG. 1 is a view showing a cross-section of a device for producing emulsions, suspensions and the like in accordance with the present invention.
Figure 4:
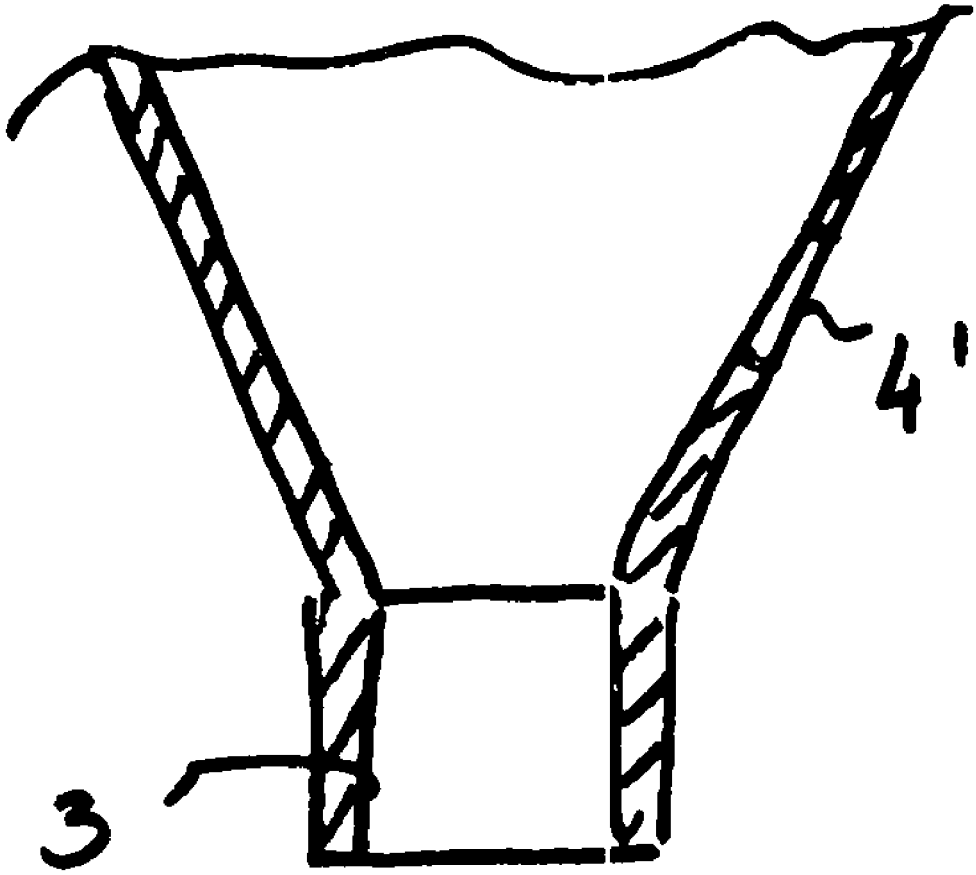
FIG. 4 is a view showing a further embodiment of the device for producing emulsions, suspensions and the like in accordance with the present invention.

A device for producing emulsions, suspensions and the like is identified as a whole with reference numeral 1. It has a reservoir which is substantially tubular, and more particularly is substantially cylindrical and limited by a substantially cylindrical wall 2. The reservoir has an axis A and is provided with a first inlet 3, a second inlet 4, and an outlet 5.

The first inlet 3 is formed for introduction of a first medium and it is located at one axial end of the reservoir 1. The second inlet 4 is provided for introduction of a second medium and it is formed in the substantially cylindrical wall 2 of the reservoir 1. The outlet 5 is formed for discharging a mixture of the first and second media and it is formed at an opposite axial end of the reservoir 1.

As can be seen from the drawings the first inlet 3 is formed so that stream of the first medium is introduced into the interior of the reservoir 1 substantially in an axial direction, while the second inlet 4 is formed so that the second medium is introduced into the interior of the reservoir 1 in a direction which is transverse to the axis A and therefore is transverse to the direction of flow of the stream of the first medium.

The first inlet 3 is located at a first axial end of the tubular member 2, the second inlet 4 is located in the wall of the tubular member 2, and the outlet 5 is located at the opposite axial end of the tubular member 2.

Means is provided for imparting vibrations to the stream of the first medium, as identified with reference numeral 6. The vibration imparting means 6 include means for subdividing the stream of the first medium into a plurality of individual streams. In the shown embodiment the means for subdividing the stream of the first medium into a plurality of individual streams includes for example two plates 7 and 8 which intersect one another to split the stream of the first medium into four individual streams. The plates 7 and 8 have cutting edges 9 provided on both sides of the blades.

A disc 10 can be further provided at a close location and formed with a plurality of curved elements 11 on its face which faces the inlet 3. The elements 11 can be formed as curved ribs, which for example can have a screw shape. The plates 7 and 8, in accordance with one embodiment can be connected with the ring 10, so as to form a single unit.

The plates 7, 8 and the ring 10 are located downstream of the first inlet 3 in direction of flow of the stream of the first medium.

Additional means which act on a mixture of the first and second media are located downstream of the second inlet 4. These additional means include an insert 12 which is provided with an inner shaped surface 13 formed so as to turn a stream of the mixture flowing through its interior in an axial direction around the axis A. For example the inner surface 13 can be screw-shaped.

The insert 12 can be formed elastic in a transverse direction, or in other words substantially perpendicular to the axis A. For this purpose, the insert 12 can be formed for example as bellows, can be provided with outer pockets 14 between its outer surface and an inner surface of the cylindrical wall 2, etc. It is to be understood that the additional means can include one insert which is provided with the inner shaped surface, and another insert located axially adjacent to the one insert and formed elastic in the transverse direction. However, in the shown embodiment these two features are combined in the single insert 12.

The additional means further have a ring 15 provided with a plurality of blades 16. The blades 16 are arranged at an angle $\alpha=f(\nu)$, relative to the axis A of the device, wherein $\nu$ is a kinematic viscosity coefficient of the mixture formed by the first and second media. In turn, $$\nu = \frac{\rho}{\gamma},$$

where $\rho$ is a density of the mixture, and $\gamma$ is its specific weight.

A device for reducing of emulsions, suspensions and the like in accordance with the present invention operates in the following manner.

A first medium, for example fuel is supplied through the first inlet 3 into the reservoir 1. The stream of the first fluid is first of all turned by the curved elements 11 of the disc 10, and then passes between the plates 7 and 8 so as to be subdivided into four individual streams. When the stream of the first fluid first heats the cutting edge 9 of the plates 7 and 8, it obtains vibrating movements substantially in an axial direction. Thus, the individual streams of fuel which pass through the above mentioned elements obtain vibrating movements. A second medium is introduced through the second inlet 4 into the interior of the tubular element 1 transversely to the vibrating stream of the first medium and mixes with the latter. The mixture then flows into the insert 12 in which it is spinned due to the inner shaped surface of the insert. Since the insert 12 is composed of an elastic material and also can be shaped (in form of a bellows, with outer pockets, etc.), it performs transverse vibrations under the action of the mixture and causes additional transverse vibrations in the mixture. The mixture further reaches the blades 16 and is thrown by the blades so as to be subjected to turbulent.

It is believed to be clear that the media and their mixture in the device is subjected to multiple pulsations or vibrations of different types and in different directions, and thereby a highly homogeneous and finely dispersed emulsion is obtained. The tubular reservoir, in addition, prevents formation of dead zones and therefore provides high efficiency of the device, so that the size of reservoir is substantially not limited.

In the embodiment shown in FIG. 2, the majority of the elements of this embodiment substantially correspond to the elements of the embodiments shown in FIG. 1 and therefore they are identified with the same reference numerals. The difference between the device shown in the embodiment of FIG. 2 from the device shown in the embodiment of FIG. 1, is that the second inlet 4' for introducing the second medium is located directly upstream of the first inlet 3 so as to provide mixing of the both media with one another and to produce a mixture, which then is subjected to multiple actions of the corresponding elements of the device.

It will be understood that each of the elements described above, or two or more together, may also find a useful application in other types of constructions differing from the types described above.

While the invention has been illustrated and described as embodied in a device for reducing of emulsions, suspensions and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for producing emulsions, suspensions and the like with at least two media, comprising a substantial tubular reservoir provided with a first inlet at one axial end so that a first medium is supplied substantially in an axial direction, a second inlet for a second medium provided in a substantially tubular wall of said reservoir so that said second medium is supplied into said reservoir substantially transversely to said axis and therefore said first medium to produce a mixture, and an outlet for discharging the mixture of the first and second medium; means for imparting vibrations to the first medium and located downstream of said first inlet and upstream of said second inlet; means for turning a stream of the first medium and the second medium and located downstream of said second inlet; and means for imparting turbulence to a mixture of the first and second media before discharging through said outlet and located downstream of said means for turning a stream of the first and second media around said axis.

2. A device as defined in claim 1, wherein said means for imparting vibrations include an element formed by two intersecting plates subdiving the stream of the first media into four individual stream, said means for turning the stream of the first and second media around said axis including a plurality of curve formations arranged on an element extending transversely to said axis configured as an insert having a shaped inner surface so as to turn the mixture of said first and second media around said axis when it passes through said insert, and said means for imparting turbulence to the mixture of said first and second media including a plurality of blades which are arranged at an angle to said axis, so that a mixture of the first and second media is subjected to turbulent pulsations.

3. A device as defined in claim 1, wherein said means for turning the stream of the first and second media on said axis is configured as an insert which is provided with an inner shaped surface formed so as to turn the stream and formed as elastic bellows provided with outer pockets between its outer surface and an inner surface of a cylindrical wall of said tubular reservoir.

* * * * *